US005340111A

United States Patent [19]

Froelich

[11] Patent Number: 5,340,111

[45] Date of Patent: Aug. 23, 1994

[54] GOLF DRIVING RANGE PLATFORM

[76] Inventor: David S. Froelich, 14455 Broadmoor St., Panorama City, Calif. 91402

[21] Appl. No.: 75,031

[22] Filed: Jun. 10, 1993

[51] Int. Cl.[5] ..... A63B 69/36

[52] U.S. Cl. ..... 273/195 B; 108/7

[58] Field of Search ..... 273/195 B, 183 A, 195 A, 273/195 R, 32 R, 35 R, 147 R, 198; 607/95; 108/1-10, 27, 38, 54.1; 472/92, 93, 91, 130, 135

[56] References Cited

U.S. PATENT DOCUMENTS

| | | | |
|---|---|---|---|
| 2,937,875 | 5/1960 | Mason | 273/195 B |
| 3,633,917 | 1/1972 | Anderson | 273/195 B |
| 3,633,918 | 1/1972 | Smiley | 273/195 B |
| 3,869,127 | 3/1975 | Kohori | 273/195 A |
| 4,875,684 | 10/1989 | Benilan | 273/195 B |
| 5,005,837 | 4/1991 | Martinez | 273/195 B |

FOREIGN PATENT DOCUMENTS

| | | | |
|---|---|---|---|
| 4189377 | 7/1992 | Japan | 273/195 R |

*Primary Examiner*—Mark S. Graham

*Attorney, Agent, or Firm*—Blakely, Sokoloff, Taylor & Zafman

[57] ABSTRACT

A golf practice apparatus that includes a platform that is pivoted about a universal Joint by a pair of hydraulic actuators. The universal joint couples the platform to a centrally located post which extends from a base structure. The universal joint is located in close proximity to the platform so that a centrally located player is not laterally displaced when the platform is rotated about the joint. The apparatus also has a spherically shaped cowling that cooperates with a cylindrically shaped shroud to completely enclose the underside of the platform. Movement of the actuator pistons is controlled by a pair of solenoid control valves which receive input signals from a foot switch. The foot switch has a plurality of buttons which can be depressed by the user to move the platform into a number of different positions.

7 Claims, 2 Drawing Sheets

GOLF DRIVING RANGE PLATFORM

BACKGROUND OF THE INVENTION

1. Field of the Invention

The present invention relates to a golf practice apparatus which has a platform that supports a player and can be tilted into a plurality of different positions.

2. Description of Related Art

Golf courses may have various hills or sloped areas which generally increase the difficulty of the game. The inclined surfaces will cause the golfer to vary their swing throughout the course. Many golfers practice swinging a golf club at a driving range or other facility, where he or she may repeatedly strike a golf ball while standing in the same location. Because the golfer is standing in the same location, the grade of the ground beneath the player is always the same level. The golfer is therefore unable to practice swinging on surfaces with various gradings. It is desirable to have an apparatus that will vary the angle of the ground beneath the golfer at a facility such as a driving range.

U.S. Pat. No. 5,005,837 issued to Martinez, discloses a golf practice device that includes a platform which has one end pivotally connected to a base structure. An actuator is operatively connected to both the base structure and the platform, so that movement of the actuator piston lifts the platform at an angle inclined to the ground.

U.S. Pat. No. 2,937,875 issued to Mason et al., discloses a golf practice apparatus which has a platform connected to a centrally located actuator. The platform has a plurality of hinge elements that become aligned with corresponding hinge elements of a base member. The platform is rotated to an inclined position by inserting a pin through the hinge elements on one side of the platform and then moving the actuator piston in an upward direction.

U.S. Pat. No. 3,633,918 issued to Smiley et al., discloses a golf practice apparatus which has a pair of electric motors coupled to a platform. The platform is supported by a pair of V shaped angle braces that pivot about a first pin that extends through an intermediate member. The intermediate member pivots about a second pin that extends through a pair of inverted V shaped angle braces which are attached to a base structure. The electric motors move the platform about the pins in response to the operation of a control box. The pivot points of the Smiley device are located away from the platform such that the whole platform is tilted about the base structure. Tilting the entire platform will cause the player to stand at an angle, thereby effecting his balance. Additionally, the golf platforms of the prior art leave expose the underside of the platform. Exposing the joints, actuators, etc. of the apparatus is unsightly and may create a safety hazard. It is therefore desirable to have a tilting golf practice platform that is safe and accurately simulates playing golf on a graded surface.

SUMMARY OF THE INVENTION

The present invention is a golf practice apparatus that includes a platform that is pivoted about a universal joint by a pair of hydraulic actuators. The universal joint couples the platform to a centrally located post which extends from a base structure. The hydraulic actuators are coupled to the platform by spherical Joints which together with the universal joint allow the platform to move into a plurality of inclined positions relative to the base structure. The universal joint is located in close proximity to the platform so that there is no lateral displacement of the platform. Maintaining the position of the platform center allows the platform to be tilted without displacing the player.

The apparatus also has a spherically shaped cowling that cooperates with a cylindrically shaped shroud to completely enclose the underside of the platform. Movement of the actuator pistons is controlled by a pair of solenoid control valves which receive input signals from a foot switch. The foot switch is located on top of the platform and includes a plurality of buttons which can be depressed by the user to move the platform into a number of different positions.

It is therefore an object of the present invention to provide a tilting golf practice platform which does not laterally displace the center of the platform.

It is also an object of the present invention to provide a tilting golf practice platform which conceals the underside of the platform.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
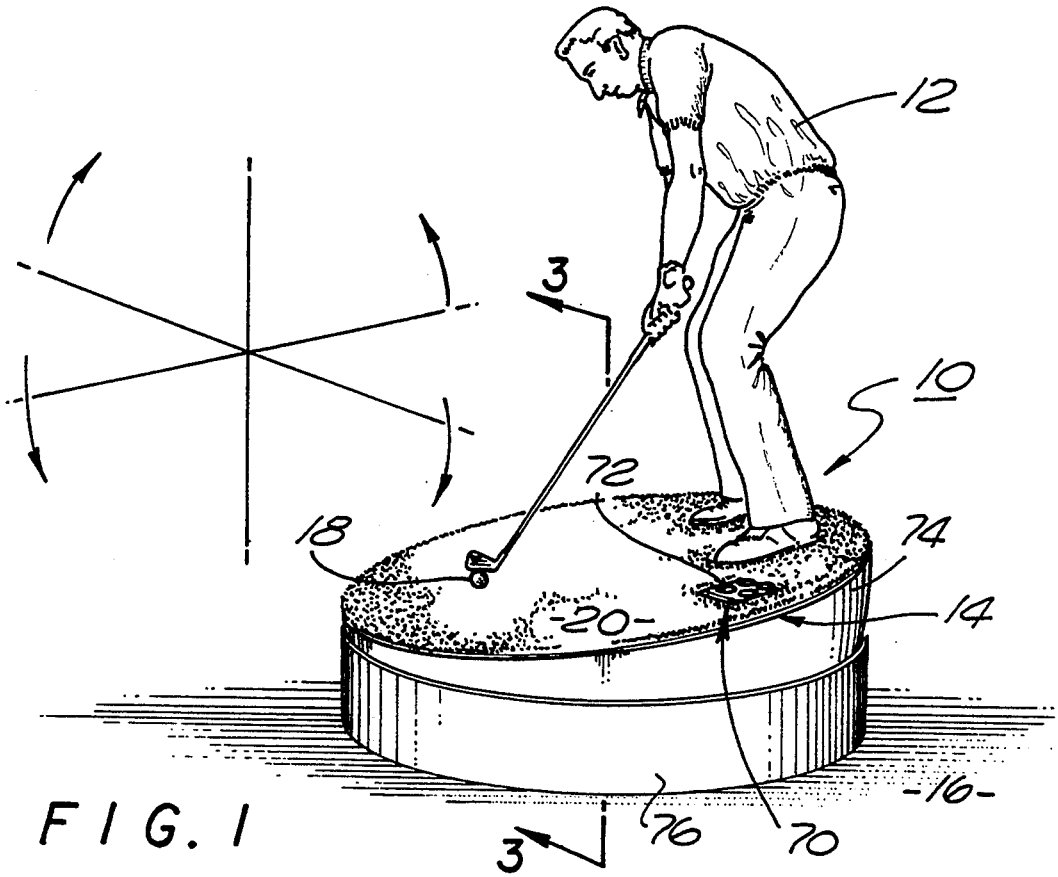
FIG. 1 is a perspective view of a golf practice apparatus of the present invention.

Referring to the drawings more particularly by reference numbers, FIG. 1 shows a golf practice apparatus 10 of the present invention. The apparatus 10 is typically used by a golfer to practice his or her golf swing. The player 12 stands on top of a platform 14 which is adapted to be tilted relative to the ground 16. Tilting the platform 14 allows the player to practice hitting golf balls 18 on a surface with different grades, thereby more accurately approximating the play on an actual golf course. The top surface of the platform 14 is preferably covered with a synthetic turf 20 which simulates natural grass and maintains the position of the golf ball 18.

Figure 2:
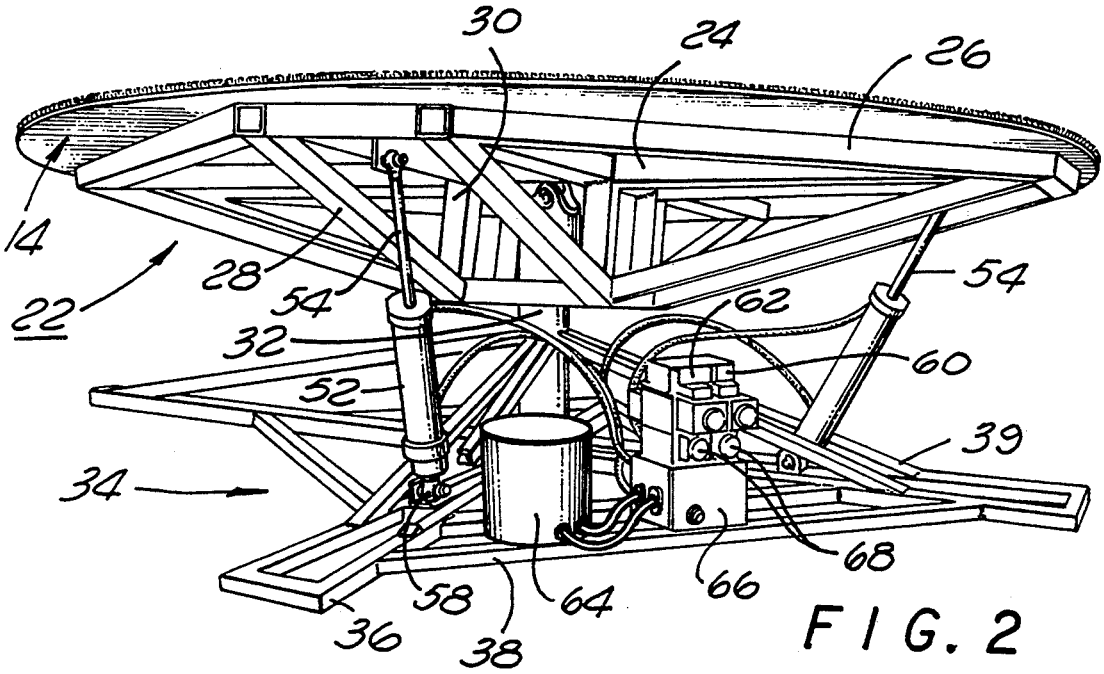
FIG. 2 is a side elevational view of the golf practice apparatus.
Figure 3:
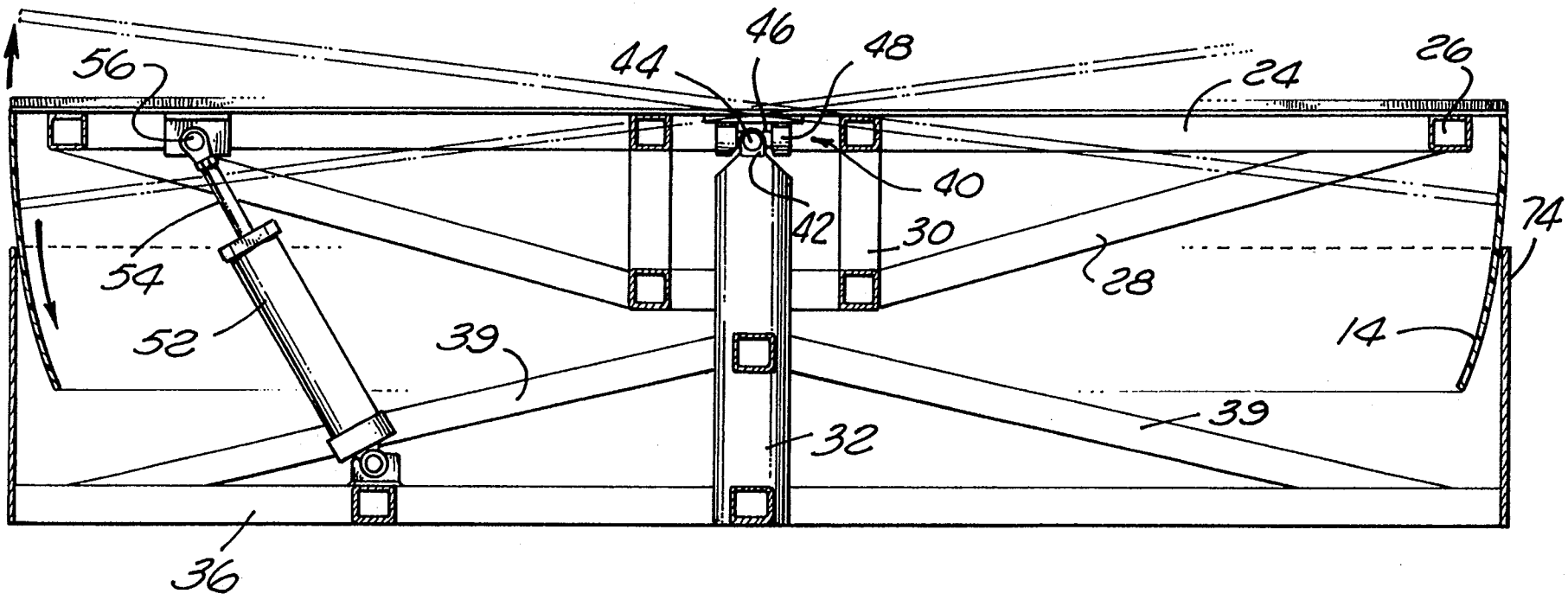
FIG. 3 is a side view of the golf practice apparatus.

As shown in FIGS. 2 and 3, the platform 14 is supported by a metal frame 22. The frame 22 includes a number of longitudinal beams 24 that are attached to a plurality of outer beams 26. Extending from the end of the longitudinal beams 24 are a number of angle braces 28 that are attached to a cage 30. The cage 30 surrounds a post 32 which is mounted to a base structure 34.

The base structure 34 includes four feet 36 that are each typically constructed from a pair of beams. Between the feet 36 are angle braces 38 which increase the stiffness of the structure 34. The post 32 is further supported by angles braces 39 that are attached to the end of the feet 36.

As shown in FIG. 3, the platform 14 is coupled to the post 32 by a universal joint 40. The joint 40 includes a first bracket 42 which is connected to the post 32 and which supports a first pin 44. The first pin 44 extends through a second pin 46 that is adapted to rotate relative to the first pin 44 and post 32. The second pin 46 is supported by a pair of brackets 48 attached to the frame 22. The second pin 46 is typically captured by a pair of C clips (not shown) which allow the brackets 48 and frame 22 to rotate relative to the second pin 46 and post 32. In the preferred embodiment, the platform 14 is constructed from a 0.125 inch thick plate of steel and the beams are constructed from 1 inch square steel tubing. Such a construction has been found sufficient to support a golfer. The universal joint 40 is located adjacent to the platform 14 so that the platform 14 pivots about its center. With such an arrangement, the center of the platform 14 does not move when the platform 14 is tilted. Therefore, the player will not be laterally displaced by an rotation of the platform.

Extending from the base structure 34 are a pair of hydraulic linear actuators 50 and 52. The actuators each have a piston 54 that is coupled to the frame by a spherical bearing 56. The spherical bearings 56 allow the frame 22 and platform 14 to be rotated relative to the actuators. The opposite ends of the actuators are also coupled to the base structure 34 by spherical bearings 58. Defining the platform by first, second, third, and fourth quadrants, the first actuator 50 is attached to the frame 22 in the first quadrant and the second actuator 52 is attached to the frame 22 in the second quadrant. The location of the actuators provides a movement of the platform 14 about two separate and essentially perpendicular axis, which allows the operator to move the platform into a plurality of different positions.

As shown in FIG. 2, the actuators 50 and 52 are connected to control valves 60 and 62. The control valves are coupled to a pump unit 64 by a manifold 66. In the preferred embodiment, the control valves are double solenoid 4-way control valves that each have control buttons 68. Additionally, the control valves are wired to a foot switch 70 located on top of the platform 14. The foot switch 70 has a plurality of buttons 72 that simultaneously activate the pump 64 and energize a corresponding control valve when depressed by the player. The platform 14 can be tilted by depressing one of the buttons 72. When the platform 14 reaches a desired position, the button 72 is released, wherein the control valve is closed and the pump is deactivated.

The apparatus 10 may also have a cowling 74 attached to the platform 14 and a shroud 76 connected to the base structure 34. Both the cowling 74 and the shroud 76 are preferably constructed from sheets of steel bent into a spherical and cylindrical shapes, respectively. The outer diameter of the cowling 74 is slightly less than the inner diameter of the shroud 76 so that the two members do not interfere with each other when the platform 14 is tilted. The combination of the cowling 74 and the shroud 76 completely enclose the underside of the platform 14 to conceal the various joints and actuators of the apparatus.

In operation, the golfer depresses the buttons 72 to actuate the pump and move the actuator(s) until the platform is tilted to a desired position. The golfer can then practice hitting golf balls along the inclined surface. The platform can be tilted to a new position by again depressing one of the buttons 72. The apparatus may include a limit switch (not shown) coupled to the platform and the pump to deactivate the pump when the platform has rotated to a predetermined position. The limit switch prevents the platform from tilting to an undesirable inclined position and provides a back-up shut off switch in the event that the control valves malfunction.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A golf practice apparatus, comprising:

a base structure;

a platform having an outer edge and being defined by first, second, third and fourth quadrants;

a post that extends from said base structure;

a universal joint that couples said platform to said post;

a first actuator that has a first piston coupled to said platform in said first quadrant;

a second actuator that has a second piston coupled to said platform in said second quadrant;

control means for moving said first and second pistons relative to said base structure, wherein said platform pivots about said universal joint;

a cylindrical shroud attached to said base structure; and, a spherical cowling attached to said outer edge of said platform, said cowling cooperating with said shroud to enclose said universal joint and said actuators.

2. The golf practice apparatus as recited in claim 1, wherein said first piston is coupled to said platform with a first spherical joint and said second piston is coupled to said platform with a second spherical joint.

3. The golf practice apparatus as recited in claim 1, wherein said control means includes a pump, a first solenoid control valve operatively connected to said pump and said first actuator, and a second solenoid control valve operatively connected to said pump and said second actuator.

4. The golf practice apparatus as recited in claim 3, wherein said control means includes a plurality of buttons coupled to said pump and said solenoid control valves.

5. The golf practice apparatus as recited in claim 4, further comprising a foot switch having two first buttons that control said first solenoid control valve and two second buttons that control said second solenoid control valve.

6. A golf practice apparatus, comprising:

a base structure having an outer edge;

a frame;

a platform attached to said frame and being defined by first, second, third and fourth quadrants, said frame having an outer edge;

a post that extends from said base structure;

a universal joint that couples said platform to said post, said universal joint being located within said frame;

a first actuator that extends from said base structure, said first actuator having a first piston;

a first spherical joint that couples said first piston to said platform in said first quadrant;

a second spherical that extends from said base structure, said second actuator having a second piston;

a second spherical joint that couples said second piston to said platform in said second quadrant;

a first solenoid control valve operatively connected to said first actuator;

a second solenoid control valve operatively connected to said second solenoid control valve;

a pump operatively connected to said first and second solenoid control valves;

a foot switch operatively connected to said first and second solenoid control valves; a cylindrical shroud attached to said base structure; and a spherical cowling attached to said outer edge of said platform, said cowling cooperating with said shroud to enclose said valves and said actuators.

7. The golf practice apparatus as recited in claim 6, wherein said foot switch has two first buttons that control said first solenoid control valve and two second buttons that control said second solenoid control valve.

* * * * *